US011759074B2

(12) United States Patent
Droguett Larrain

(10) Patent No.: US 11,759,074 B2
(45) Date of Patent: Sep. 19, 2023

(54) SUCTION ACCESSORY DEVICE FOR VACUUMING AND CLEANING HARD-TO-REACH AND/OR DELICATE PLACES AND OBJECTS

(71) Applicant: Juan Claudio Droguett Larrain, Lo Barnechea (CL)

(72) Inventor: Juan Claudio Droguett Larrain, Lo Barnechea (CL)

( * ) Notice: Subject to any disclaimer, the term of this patent is extended or adjusted under 35 U.S.C. 154(b) by 0 days.

(21) Appl. No.: 17/461,691

(22) Filed: Aug. 30, 2021

(65) Prior Publication Data

US 2022/0167812 A1 Jun. 2, 2022

(30) Foreign Application Priority Data

Nov. 27, 2020 (CL) ..... 202003104

(51) Int. Cl.
*A47L 9/24* (2006.01)
*A47L 9/06* (2006.01)

(52) U.S. Cl.
CPC ..... *A47L 9/242* (2013.01); *A47L 9/06* (2013.01); *A47L 9/248* (2013.01)

(58) Field of Classification Search
CPC . A47L 9/242; A47L 9/248; A47L 9/24; A47L 9/02; A47L 9/068; A47L 9/0693; A47L 7/0076; A47L 7/008; A47L 7/009; A47L 5/225; A47L 5/24; A47L 5/32; A47L 5/36; A47L 5/362; A47L 9/0606; A47L 9/062; A47L 9/104; A47L 9/0072; A47L 7/0095; A47L 9/06–0626
USPC ..... 15/363, 421, 375
See application file for complete search history.

(56) References Cited

U.S. PATENT DOCUMENTS 3,381,328 A * 5/1968 Szabo ..... A47L 9/0072 15/375
5,050,266 A * 9/1991 Schneider ..... A47L 9/242 15/375
5,297,310 A * 3/1994 Cox ..... B08B 9/0436 15/106

(Continued)

FOREIGN PATENT DOCUMENTS

CL 199400924 9/1993
CN 101273862 A 9/2012

(Continued)

OTHER PUBLICATIONS

PELCO® Vacuum Pick-Up System with Pump retrieved from: https://www.tedpella.com/grids_html/Vacuum-Pick-Up-Systems.htm.

*Primary Examiner* — Don M Anderson
*Assistant Examiner* — Jason Khalil Hawkins
(74) *Attorney, Agent, or Firm* — Muncy, Geissler, Olds & Lowe, P.C.

(57) ABSTRACT

A suction accessory device is provided, for the connection with a suction apparatus or vacuum cleaner, for the collection of waste in places of difficult access and/or in delicate objects. The suction accessory device comprises a flexible and lightweight hose. At one end, the hose includes a reducing coupling adapter terminal for connecting to a vacuum cleaner or suction device. At the opposite end, the hose includes a nozzle connection terminal that is coupled to a first end of a flexible or rigid, handle or brush tube. At a second end of the brush tube, the brush tube includes a head connection terminal which connects to interchangeable suction heads or nozzles.

9 Claims, 9 Drawing Sheets

(56) References Cited

U.S. PATENT DOCUMENTS

| | | | | |
|---|---|---|---|---|
| 5,926,895 | A * | 7/1999 | Roy | B25G 1/02 15/164 |
| 6,122,792 | A * | 9/2000 | Roy | A46B 5/0062 15/164 |
| 6,813,810 | B2 * | 11/2004 | Beynon | A47L 7/02 15/406 |
| 7,779,860 | B2 * | 8/2010 | Pears | A47L 9/0072 15/375 |
| 8,402,604 | B2 | 3/2013 | Dant | |
| 8,402,986 | B1 * | 3/2013 | Gray | A47L 7/04 137/223 |
| 8,627,544 | B2 | 1/2014 | Habboush | |
| 8,689,983 | B1 * | 4/2014 | Ripley | B07B 4/08 15/418 |
| 9,596,967 | B2 | 3/2017 | Lee et al. | |
| 9,629,510 | B1 * | 4/2017 | Willhoyt | A47L 9/248 |
| 9,782,048 | B2 | 10/2017 | Witter et al. | |
| 10,420,447 | B2 | 9/2019 | Jones et al. | |
| 10,631,696 | B1 | 4/2020 | Williamson | |
| 10,849,475 | B1 * | 12/2020 | Williamson | A47L 9/06 |
| 11,259,628 | B1 * | 3/2022 | Saniga | A47L 9/122 |
| 2006/0179607 | A1 | 8/2006 | Ptak et al. | |
| 2008/0034522 | A1 | 2/2008 | Gipson | |
| 2012/0124771 | A1 * | 5/2012 | Gooden | A47L 5/26 15/344 |

FOREIGN PATENT DOCUMENTS

| | | | |
|---|---|---|---|
| CN | 204445690 | U | 7/2015 |
| CN | 209136442 | U | 7/2019 |
| DE | 10245185 | B3 | 3/2003 |
| DE | 29825237 | U1 | 11/2006 |
| JP | 2001008865 | | 1/2001 |
| JP | 4001131 | B2 | 10/2007 |
| JP | 2020054769 | A | 4/2020 |
| WO | 0100078 | A1 | 1/2001 |
| WO | 02067748 | A1 | 9/2002 |
| WO | 2018149786 | A2 | 8/2018 |

* cited by examiner

SUCTION ACCESSORY DEVICE FOR VACUUMING AND CLEANING HARD-TO-REACH AND/OR DELICATE PLACES AND OBJECTS

CROSS-REFERENCE TO RELATED APPLICATIONS

This application claims the priority to Chilean Patent Application No. 202003104, filed on Nov. 27, 2020, which is incorporated by reference herein in its entirety.

FIELD OF THE INVENTION

The present invention relates to suction or aspiration devices, particularly to apparatus containing suction nozzles connected to a vacuum source. More specifically, the invention refers to an accessory aspirator device for both domestic and industrial applications, which includes a relatively thin, long, and flexible hose to be connected to a vacuum apparatus, and a less flexible, or rigid, handheld brush tube which is attached to the hose and can be held with one hand similarly to a pencil, facilitating maneuverability of the device, aspirating hard-to-reach areas, and careful cleaning of delicate objects.

BACKGROUND OF THE INVENTION

Suction devices are generally configured to suction waste from a target area or item through the generation of a vacuum through positive pressure. These devices can be used in the medical field, for the aspiration of liquids, in the industrial and domestic fields for the cleaning of waste, or to collect other waste.

Regarding the domestic field, conventional suction cleaners or devices currently available in the market include accessories which enable the use of said devices for cleaning different places or areas. These accessories generally correspond to plastic nozzles that have various shapes which allow the device to cover different places. However, this type of accessory becomes a problem for the user when the need is to clean hard-to-reach places such as shelves, or in general any narrow area where a large conventional nozzle does not fit or cannot be maneuvered.

Furthermore, certain delicate places and objects cannot be exposed to conventional vacuum cleaners, since the high power, rigidity, and hard-to-maneuver parts of such vacuum cleaners will affect the integrity of the object or piece. Thus, cleaning such delicate places and objects may be difficult. Examples of such delicate places and objects that must be cleaned with subtlety and with low power are books, paintings, antiques, jewelry and collectibles. Similarly, cleaning in the archaeology field presents a problem equivalent to those mentioned heretofore.

Various accessories have been designed to solve the problem of cleaning in difficult places. For example, a product known as "PELCO® Vacuum Pick-Up System with Pump" provides a suction system that allows picking up delicate, lightweight material with a finger-controlled vacuum that includes interchangeable pencil heads or needles.

With respect to patent documents associated with this type of technology, document U.S. Pat. No. 8,627,544 presents a system and a method for a suction nozzle that is joined to a vacuum source, for waste collection, where the suction nozzle includes a tubular funnel to channel airborne debris to the vacuum source. Additionally, this nozzle includes a connector on the opposite side of the funnel to connect the nozzle to a vacuum source. The funnel mouth may further include an inwardly extending edge portion, which is configured to accommodate objects that may be adjacent to the funnel and the funnel mouth. The mouth includes a lip that extends inward from the edge of the mouth to help deflect debris into the funnel. A scraper portion extending into the funnel mouth from the edge can also be included in the funnel and is useful for debris removal.

Another example is document JP2001008865, in which a nozzle is presented as a vacuum cleaner accessory that is coupled to a suction hose that is in turn connected to a vacuum cleaner. This nozzle is shaped like a pen, which allows cleaning a duct or the like. Furthermore, when this nozzle is connected to a suction hose by means of fixing means, the nozzle acquires an inverted "V" shape in cross section.

Additionally, suction accessories have been presented that allow the cleaning of delicate places. This is the case of document CN204445690U, which discloses a suction tube for cleaning electronic parts. Said tube is in the shape of a helical flute that increases dust removal, which increases cleaning efficiency by 99%. Document CN101273862A discloses a manual suction nozzle that is placed in a dust collector. The nozzle disclosed in this document is tubular and comprises a brush in the suction channel.

Furthermore, document U.S. Pat. No. 9,596,967 presents a cleaner that is connected to a suction system that comprises a handle tube for handling, a flexible hose that connects the handle tube to the body, an extension tube that connects the suction head to the handle tube, and a set of accessories attached to the handle tube that allows modification of the suction head, including a brush, a crevice tool to clean a gap and an upholstery tool to clean fabrics, the tool for upholstery being rotatably attached to the accessory body.

Until now, cleaning devices and accessories include interchangeable heads, but they do not consider in their design the usefulness of efficient cleaning in a smaller, punctual and limited field of action, in a particular object or place, in a delicate and delicate way, which is comfortable for the user.

SUMMARY OF THE INVENTION

The present invention is directed to a suction accessory device designed for connection to conventional vacuum cleaners, to increase maneuverability, precision, reach, and comfort of operation of the vacuum cleaner hose and allow precise and efficient cleaning of delicate objects, hard-to-reach areas, and/or pieces or places that require punctual and limited action thereon. The suction accessory device herein disclosed can be connected to existing vacuum cleaners of all sizes, which generally provide significant suction power and are readily available in homes and businesses. The invention thereby eliminates the need to purchase a special suction device intended for cleaning such delicate objects, hard-to-reach areas, or the like, which generally do not provide sufficient suction power. Furthermore, preferably lightweight embodiments of the invention allow the operator of the device to be able to perform cleaning or aspirating tasks using the invention for prolonged periods of time, even hours, thereby increasing productivity.

In a first implementation of the invention, a suction accessory device may include a flexible, first tubular member comprising a proximal end and a distal end, and a second tubular member, comprising a proximal end and a distal end. The first and second tubular members may be attachable to one another at the distal end of the first tubular member and the proximal end of the second tubular member to provide fluid communication from the distal end of the second tubular member to the proximal end of the first tubular member. The proximal end of the first tubular member may be configured to disconnectably connect to a vacuum cleaner hose, and the first tubular member may have a smaller diameter and may be more flexible than the vacuum cleaner hose. The second tubular member may be less flexible than the first tubular member and may be holdable by a single hand of a user with a hand posture equivalent to a writing hand posture adopted when writing using a writing utensil, to manually maneuver the second tubular member with said single hand of the user.

In a second aspect, the second tubular member may be flexible or rigid.

In another aspect, the first tubular member may have a diameter of between 1 to 4 cm.

In another aspect, the first tubular member may have a diameter of 2 cm.

In another aspect, the second tubular member may have a length of 20 to 30 cm.

In yet another aspect, the second tubular member may have a length of 25 cm.

In another aspect, the second tubular member may have a diameter of 1 to 4 cm.

In another aspect, the second tubular member may have a diameter of 2 cm.

In another aspect, the suction accessory device may further include a grid within the second tubular member, the grid configured to filter air passing through the second tubular member. In some embodiments, the grid may be disconnectably mounted to the second tubular member. For example, the grid may include a handle protruding from the grid to facilitate mounting and removal of the grid onto and from the second tubular member. In some embodiments, the handle may protrude axially from the grid.

In yet another aspect, the suction accessory device may further include a reducing coupling adapter terminal affixed to the proximal end of the first tubular member and configured to adapt the diameters of the first tubular member and the vacuum cleaner hose.

In another aspect, the suction accessory device may further include a suction nozzle at the distal end of the second tubular member, the suction nozzle comprising one or more nozzle openings configured to suction air into the suction nozzle and towards the distal end of the second tubular member.

In another aspect, the one or more nozzle openings may be arranged at a distal end of the suction nozzle and facing distally.

In another aspect, the one or more nozzle openings may include a circular nozzle opening.

In yet another aspect, the one or more nozzle openings may include a lobed, nozzle opening.

In another aspect, the one or more nozzle openings may be arranged at a distal end of the suction nozzle and facing laterally.

In another aspect, the one or more nozzle openings may include an elongated slot, elongately formed generally parallel to an axial direction of the suction nozzle.

In another aspect, the suction nozzle may include one or more brushes.

In yet another aspect, at least one of the one or more brushes may be made of natural hair.

In another aspect, the suction nozzle may be disconnectable from the distal end of the second tubular member.

In another aspect, the suction accessory device may further include a nozzle connection terminal at the distal end of the second tubular member. The suction nozzle may be configured to disconnectably connect to the nozzle connection terminal.

In another aspect, the suction nozzle and nozzle connection terminal may be rotatably connectable to one another. Selective rotation of the suction nozzle and nozzle connection terminal may adjust a degree of alignment of one or more side openings formed in the suction nozzle with one or more side openings formed in the nozzle connection terminal to selectively adjust an amount of air to be expelled through said side openings and prevent said amount of air from reaching the vacuum cleaner hose.

In yet another aspect, the suction nozzle may be selectable from a set of interchangeable suction nozzles.

In another aspect, the suction nozzle may include a hollow body defining a fluid passageway therethrough, the body comprising a proximal section and a distal section. The proximal section may be formed along a first axial direction and the distal section may be formed along a second axial direction. The distal section may include the one or more nozzle openings. The suction nozzle may further include one or more brushes disposed at and protruding outward from the distal section of the body.

In another aspect, the distal section may be wider than the proximal section.

In another aspect, the second axial direction may be parallel to the first axial direction.

In another aspect, the second axial direction forms an angle other than 0 and 180 degrees with the first axial direction.

In yet another aspect, the one or more brushes may include a circular brush extending outward in the second axial direction from a periphery of the one or more nozzle openings and continuously surrounding the one or more nozzle openings.

In another aspect, the one or more brushes may include a plurality of brushes extending outward in the second axial direction from a periphery of the one or more nozzle openings, the plurality of brushes arranged in spaced-apart relationship and interruptedly surrounding the one or more nozzle openings.

In another aspect, the one or more brushes may include a central brush extending outward in the second axial direction. The one or more nozzle openings may be arranged radially outward of the central brush.

In another aspect, the one or more brushes may extend outward from the distal section transversely to the second axial direction.

In yet another aspect, the one or more brushes may include a plurality of brushes extending radially outward of the distal section at angularly-spaced apart positions along the distal section.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention relates to an accessory device for cleaning elements, devices, and appliances. Specifically, the invention refers to an accessory device for domestic and industrial suction vacuum cleaners or suction devices, hereinafter referred to generically as vacuum cleaners. The invention can be connected, for instance, to a conventional household vacuum cleaner to facilitate cleaning of hard-to-reach and/or delicate areas or objects.

Figure 1:
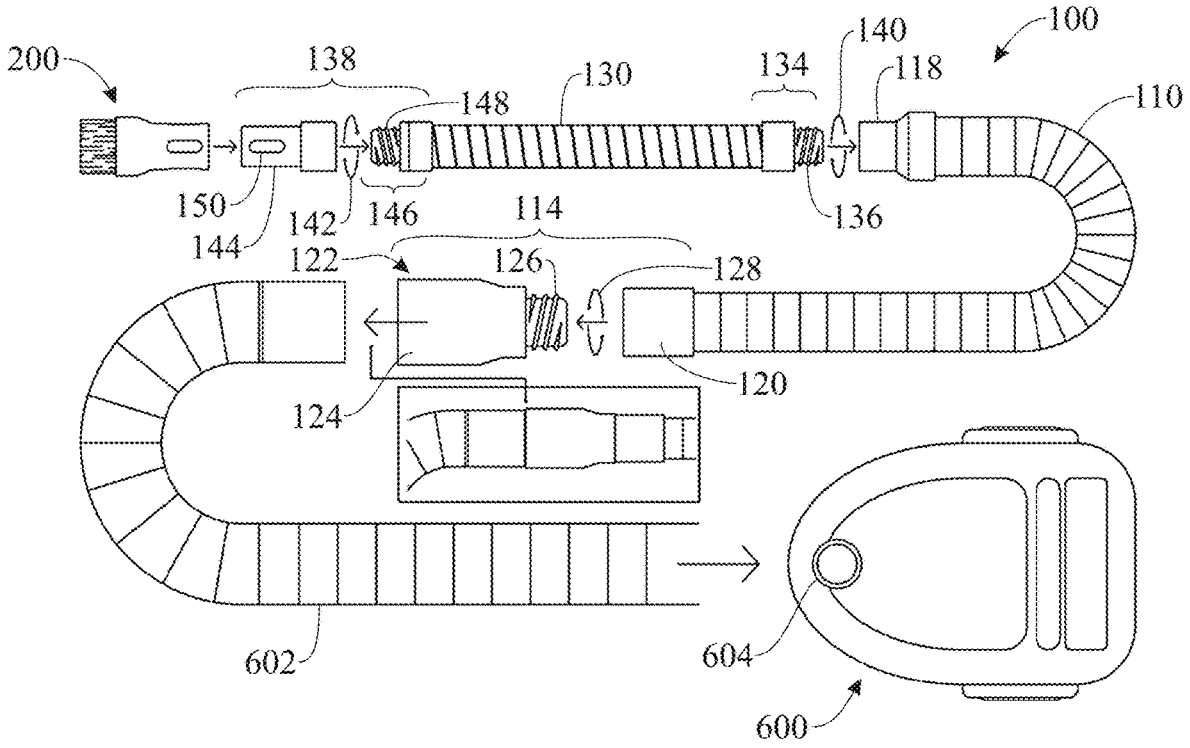
FIG. 1 presents a suction accessory device in accordance with the present disclosure, the suction accessory device shown together with a vacuum cleaner and a vacuum cleaner hose, the suction accessory device shown exploded and disconnected from the vacuum cleaner hose.

The illustration of FIG. 1 shows a suction accessory device 100 for connection with a vacuum cleaner, such as vacuum cleaner 600, for the collection of debris in places that are difficult to reach or difficult to access, and/or in delicate objects. The suction accessory device 100 comprises a first tubular member or hose 110 configured to attach to a hose 602 of the vacuum cleaner 600, which is connected to the vacuum cleaner 600 through an outlet 604 of the vacuum cleaner 600. The hose 110 may be corrugated. At a proximal end thereof, the flexible and lightweight hose 100 is connected to a proximal end of a second tubular member or brush tube 130, which is configured to be held and maneuvered by a user's hand. At an opposite, distal end thereof, the brush tube 130 is connected to a head or interchangeable suction nozzle 200.

The hose 110 is relatively long and flexible, similarly to a conventional vacuum cleaner tube, but having greater flexibility and a lighter weight than conventional vacuum cleaner tubes (e.g., hose 602), and having a smaller diameter (one-third) than the diameter of said conventional vacuum cleaner tubes used in the home. The diameter of the hose 110 is similar to that of suction tubes used in respiratory units in hospitals, with a diameter of between 1 to 4 cm, and more preferably 2 cm. The length of the hose 110 is preferably the same or longer than the length of a conventional vacuum cleaner hose (such as hose 602 of vacuum cleaner 600). The light and flexible hose 110 may be deformed such that its shape can be adapted to introduce the hose 110 into confined or difficult-to-access places, allowing to perform a series of new functions, both delicately and in a comfortable way for the user, who can even manipulate the hose 110 while seated.

With continued reference to FIG. 1, the hose 110 includes a reducing coupling adapter terminal 114 and a nozzle connection terminal 118 arranged at a proximal end and a distal end of the hose 110, respectively. The reducing coupling adapter terminal 114 at the proximal end of the hose 110 is configured to connect to the hose 602 of the vacuum cleaner 600. The nozzle connection terminal 118 at the distal end of the hose 110 is coupled to a proximal end of the brush tube 130.

The reducing coupling adapter terminal 114 shown herein comprises a proximal end connector 120 carried by or comprised in the hose 110, and an adapter 122, which is formed as a separate part. The proximal end connector 120 of the hose 110 has a small diameter, which may be substantially the same diameter as the hose 110. In turn, the adapter 122 comprises a proximal end connector 124 and a distal end connector 126. The proximal end connector 124 of the adapter 122 is configured to connect, such as frictionally, with a distal end of the hose 602 of the vacuum cleaner 602. The distal end connector 126 of the adapter 122 is configured to connect to the proximal end connector 120 of the hose 110; for instance, the distal end 126 of the adapter 122 may thread into the proximal end 120 of the hose 110, as indicated by arrow 128. As shown, the diameter of the proximal end connector 124 of the adapter 122 generally conforms to the diameter of the hose 602 of the vacuum cleaner 602, whereas the diameter of the distal end connector 126 of the adapter 122 generally conforms to the hose 110 of the suction accessory device 100. I.e., the reducing coupling adapter terminal 114 provides a coupling or adapter which transitions from the diameter of the vacuum cleaner hose 602 to the significantly smaller diameter of the suction accessory device hose 110.

The second tubular member or brush tube 130 is shorter in length than the first tubular member or hose 110. The brush tube 130 serves as a handle or holdable item, which may be grasped similarly to a brush or writing utensil (e.g., a pen or pencil), facilitating precise manual manipulation of the brush tube 130 and allowing the user to maintain a comfortable and normal posture while vacuuming. Furthermore, the brush tube 130 has an ergonomic design with heads that can be interchanged depending on the application in which the accessory is to be used. The brush tube 130 has a length of 20-30 cm and a diameter of 1-4 cm. In certain embodiments, the brush tube 130 may have a length of 25 cm and a diameter of 2 cm.

Figure 2:
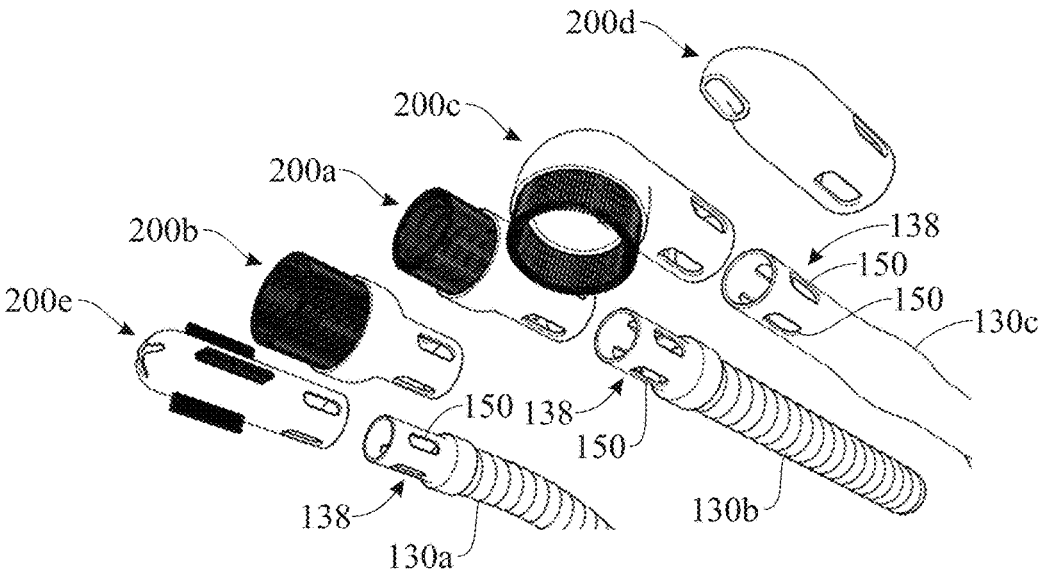
FIG. 2 presents a perspective view of three different brush tubes and five interchangeable suction heads or nozzles in accordance with an embodiment of the present disclosure.
Figure 3:
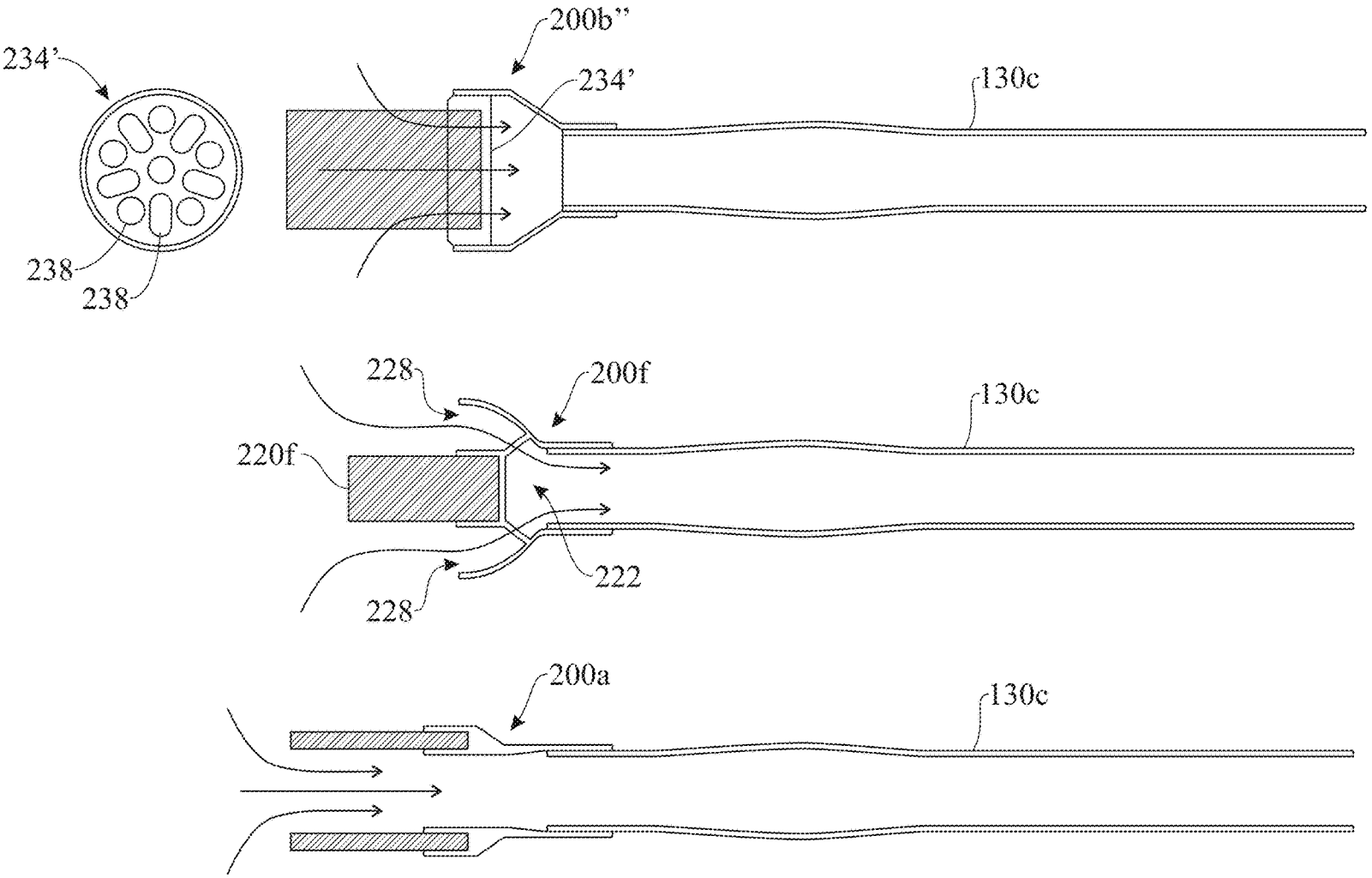
FIG. 3 presents different ways of opening the brush tube to allow intercalated aspiration, perimeter aspiration or central aspiration, and further shows a front view of a sweep nozzle and handle aspiration.
Figure 4:
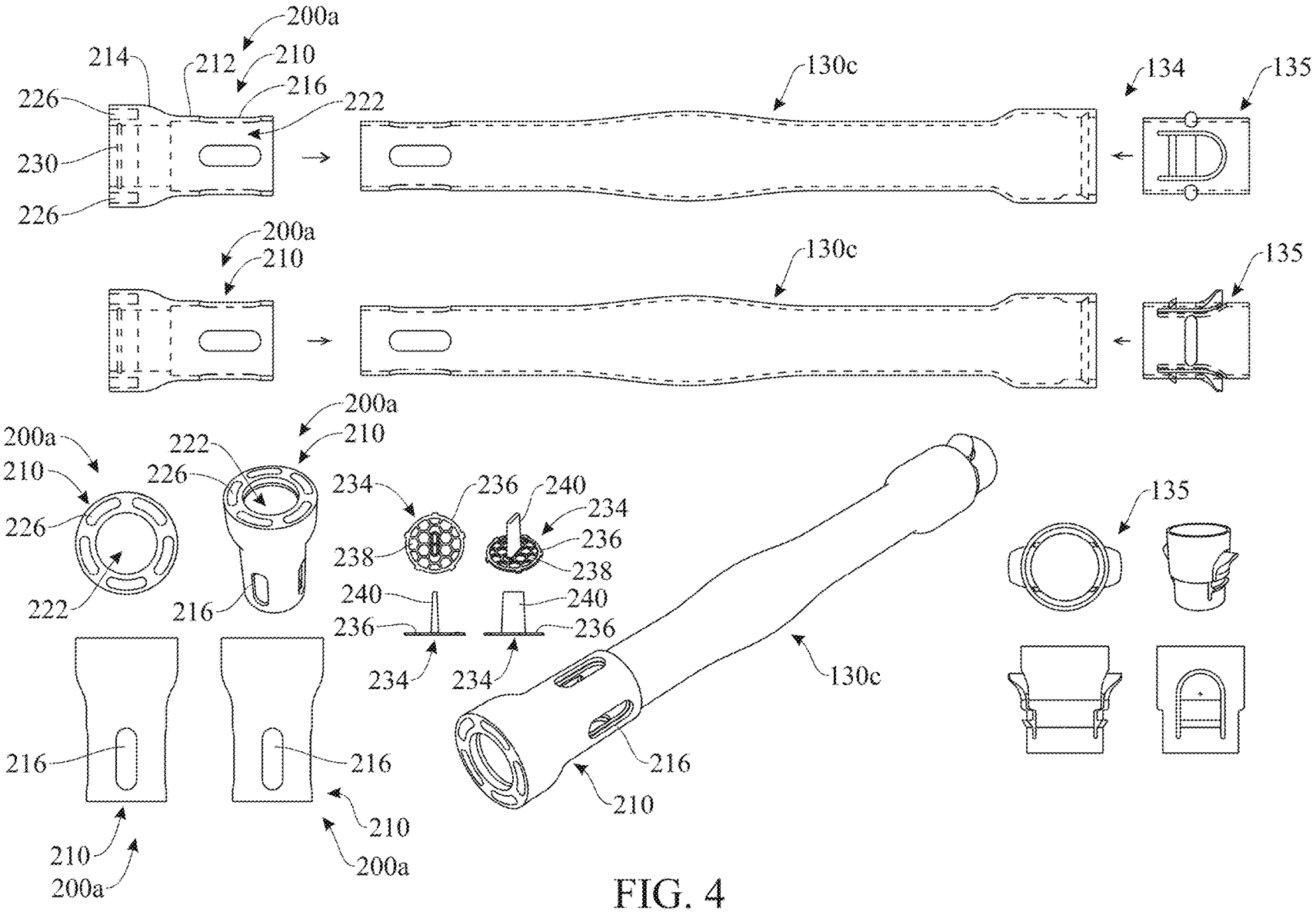
FIG. 4 presents different views of the brush tube-suction nozzle connection.

In some embodiments, the brush tube 130 may be flexible (e.g., corrugated); for instance, FIG. 2 show a flexible, first brush tube 130*a* and a flexible, second brush tube 130*b*. A flexible brush tube may facilitate extending and deforming the brush tube to access a hard-to-reach area, such as deforming the brush tube 130 to reach over and downward behind a row of books on a bookshelf. In other embodiments, the brush tube 130 may be rigid; for example, FIGS. 2-4 show a rigid, third brush tube 130*c*. A rigid brush tube may, for instance, facilitate more precisely holding the brush tube 130 as a pencil or handheld, fine paintbrush to delicately aspirate a small object such as a jewel. For simplicity, the brush tubes may be herein referred to generically using reference numeral 130, regardless of whether the brush tubes are flexible and rigid, and unless expressly indicated otherwise.

With continued reference to FIG. 1, the brush tube 130 incorporates a first terminal or hose connection terminal 134 and a second terminal or head connection terminal 138 at proximal and distal ends of the brush tube 130, respectively. The hose connection terminal 134 connects to the nozzle connection terminal 118 of the hose 110, to secure the brush tube 130 to the hose 110. In some embodiments, as shown, the hose connection terminal 134 and nozzle connection terminal 118 may be threadably connected to one another. The depicted embodiment specifically shows the hose connection terminal 134 of the brush tube 130 having a male threaded portion 136 configured to thread into the nozzle connection terminal 118, as indicated by arrow 140. Alternatively or additionally, the hose connection terminal 134 may be attachable to the nozzle connection terminal 118 by a clip-type connection, a snap-fit connection, a frictional fitting, or combinations thereof. For instance, the illustration of FIG. 4 shows an alternative embodiment in which the hose connection terminal 134 of the brush tube 130 comprises an adapter 135 which is clipped onto the proximal end of the brush tube 130*c* and is frictionally fitted to the hose of the vacuum cleaner.

The head connection terminal 138, in turn, connects the brush tube 130 to the interchangeable suction head or nozzle 200. More specifically, an end connector 144 of the head connection terminal 138 connects to the interchangeable suction head or nozzle 200. In some embodiments, such as brush tube 130*c* shown in FIG. 2, the head connection terminal 138 may be integrally-formed with an adjacent section of the brush tube 130*c*, i.e. the brush tube 130*c* includes an integrally-formed end connector 144. In other embodiments, such as brush tube 130 shown in FIG. 1, the head connection terminal 138 is non-integrally formed within the brush tube 130. More specifically, the end connector 144 is formed as a separate part and is disconnectably connectable to an end connector terminal 146 provided on the brush tube 130. As shown, the end connector 144 and end connector terminal 146 may be threadably connected to one another. The depicted embodiment specifically shows the end connector terminal 146 of the brush tube 130 having a male threaded portion 148 configured to thread into a proximal end of the end connector 144, as indicated by arrow 142. The head connection terminal 138 may be flexible. As further shown, the end connector 144 of the head connection terminal 138 is provided with a plurality of angularly-spaced apart, longitudinally elongated hatches or openings 150 for purposes that will be described hereinafter.

The head or interchangeable suction nozzle, indicated generically with reference numeral 200 in FIG. 1, may be interchangeably selected from a set of different suction nozzles, such as suction nozzles 200*a*, 200*b*, 200*c*, 200*d*, and 200*e*, shown together in the perspective view of FIG. 2, suction nozzle 200*f* shown in cross-section in FIG. 3, and other nozzle variations shown in FIGS. 3 and 10 and described hereinafter. The suction nozzles may be referred to hereinafter generically as suction nozzles 200 or individually as suction nozzles 200*a*, 200*b*, 200*c*, 200*d*, 200*e*, and 200*f*. The different available suction nozzles provide greater effectiveness in carrying out specific vacuuming tasks. They are inserted at the end of the handle or brush tube 130 and are configured to be in contact with the object to be aspirated. The different suction nozzles are designed to adapt to the different characteristics of the object to be vacuumed, as well as to adapt to the position of the user, mainly allowing the user to carry out their task in a more comfortable and effective way. It must be noted that, as shown in the figures, and particularly in FIGS. 1, 2 and 11-14, the nozzles 200 are sized significantly smaller than conventional household vacuum cleaner heads, allowing the nozzles of the present disclosure to access hard-to-reach places more comfortably and with greater delicacy.

Figure 5:
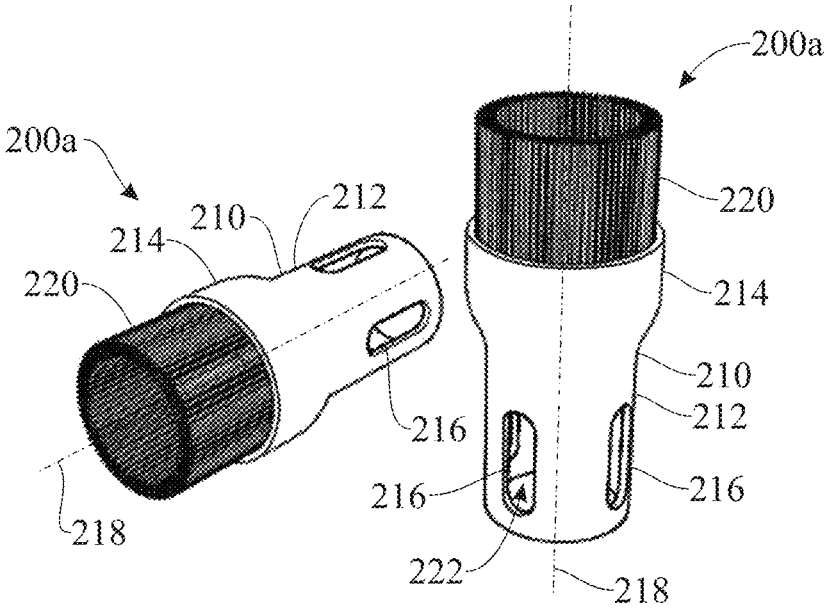
FIG. 5 presents two perspective views of a first suction nozzle of the set of interchangeable suction nozzles of FIG. 2.

The first suction head or nozzle 200*a*, enlarged views of which are shown in FIG. 5, provides a small, forwardly-oriented brush that allows cleaning in a forward direction. As shown, the first nozzle 200*a* comprises a hollow, generally cylindrical body 210 having a proximal section 212 and a distal section 214 which is wider (has a larger diameter) than the proximal section 212. The proximal section 212 is configured to connect to the end connector 144 of the head connection terminal 138 such as by friction fitting. The proximal section 212 includes a plurality of hatches or openings 216 configured to adjustably align with the plurality of openings 150 formed in the end connector 144, allowing for the graduation of the suction power by adjustably opening and closing the openings that comprise this head. For example, a user may adjust the rotational position of the body 210 relative to the end connector 144 and thereby bring the openings 216, 150 into or out of alignment with each other to adjustably open or close said openings. When the openings 216, 150 are fully out of alignment, suctioned air may not through the openings and the suction power of the suction accessory device 100 is maximized. As the openings 216, 150 are increasingly aligned, suctioned air may increasingly exit through the openings and the suction power of the suction accessory device 100 progressively decreases.

The first nozzle 200*a* further comprises an annular brush 220 arranged about a central longitudinal axis 218 of the proximal portion 212 of the body 210, which matches a central longitudinal axis of the body 210. The annular brush 220 is formed of a plurality of hairs, which extend generally along the longitudinal direction of the body 210, i.e. parallel to the central longitudinal axis 218 of the body 210. The hairs are soft and flexible, to prevent the annular brush 220 from pushing the dirt towards the object being cleaned, which could cause the dirt to adhere to the object. In some embodiments, the hairs may be, or include, natural hairs, which allow to touch the delicate object that is being vacuumed without damaging the object.

With continued reference to FIG. 5, the hairs of the annular brush 220 are forward or distally oriented, such that they provide a longitudinal extension of the body 210. I.e., the first nozzle 200*a* is straight, with the body 210 and the annular brush 220 extending along a same direction (the longitudinal direction of the first nozzle 200*a*). This straight configuration of the first nozzle 200*a* (and of variations of the first nozzle 200*a* described heretofore or hereafter) allow to carry out most of the tasks for which the suction accessory device 100 has been designed. The straight suction heads allow vacuuming from the front and in the direction of the brush, which can be more comfortable for the user depending on their position relative to the object.

An air passageway 222 is defined by the annular brush 220 and the body 210, which provides fluid communication from a distal end of the annular brush 220 to a proximal end of the body 210 to allow air and debris to travel from said distal end of the annular brush 220 to said proximal end of the body 210 and into the end connector 138 during vacuuming. This fluid passageway is also in fluid communication with the openings 216.

It must be noted that, while the annular brush 220 of the first nozzle 200*a* extends uninterruptedly about the central longitudinal axis 218 of the body 210, alternative embodiments are contemplated in which the annular brush may extend interruptedly about the central longitudinal axis 218 of the body 210. For instance, the illustration of FIG. 10 shows several different suction nozzles similar to the first nozzle 200*a*, all of which include an "interrupted" annular brush 220. For example, a smaller one of these additional suction nozzles, which provides a variation of the first nozzle 220*a* and is thus indicated with reference numeral 200*a*', includes a brush 220 which is divided into five separate hair groups 224, with each pair of adjacent hair groups 224 separated by a gap 226. In contrast, the brush 220 of first nozzle 200*a*, also shown in FIG. 10, includes a single hair group 224 which extends continuously about the central longitudinal axis 218 of the body 210.

Figure 10:
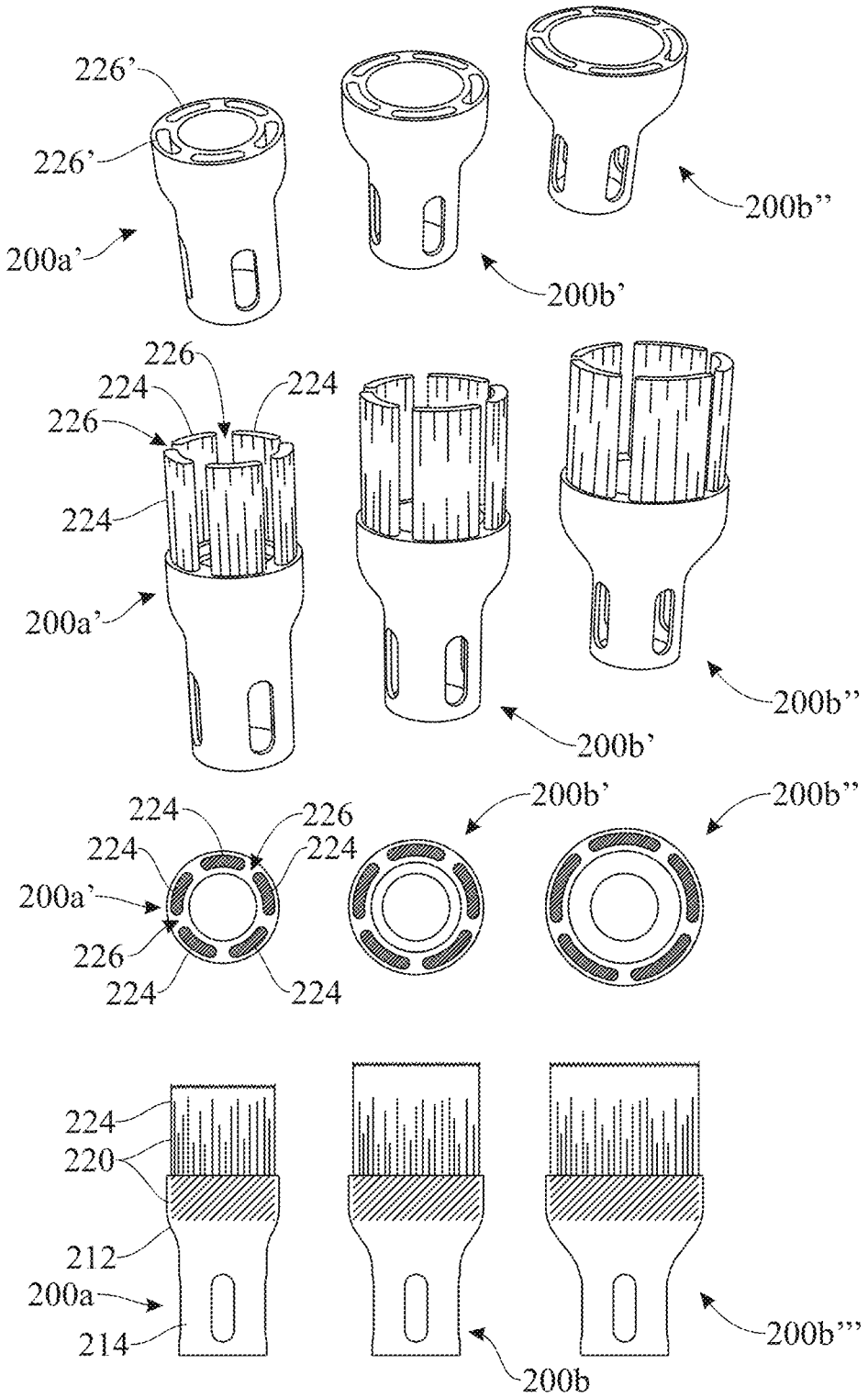
FIG. 10 presents details of the first suction nozzle and several variations thereof, which are instead provided with a discontinuous cleaning brush.

With continued reference to FIGS. 4 and 10, the body 210 of the first nozzle 200*a* includes an annular cavity 226 extending from the distal end of the distal section 214 of the body 210 and into the distal section 214. The annular cavity 226 receives the brush 220, which may be secured inside the annular cavity 226 by an adhesive. Similarly, the body 210 of nozzle 200*a*' includes a plurality of cavities 226', each of which receives a respective one of the brush groups 224, which may be secured inside the cavity 226' by an adhesive.

As further shown in FIG. 4, the body 210 of the first nozzle 200*a* further includes an internal annular recess 230 which extends into an internal wall of the distal section 214 of the body 210. The first nozzle 200*a* may further include a grid or grill 234, which can be installed inside the first nozzle 200*a*. The depicted grill 234 includes a generally flat or disc-shaped grill body 236, provided with a plurality of small openings 238, and an elongated protrusion or handle 240 which extends generally perpendicularly from the grill body 236, and preferably from a center of the grill body 236. To mount the grill 234, the grill body 236 is inserted into the distal section 214 of the body 210 of the first nozzle 200*a* and is seated within the internal annular recess 230, with the handle 240 oriented towards the distal end of the body 210 (i.e. towards the brush 220). The grill 234 may capture larger debris particles during use of the device. For example, the grill 234 may capture valuable residue, such as in cases where the apparatus is being used by a jeweler and a valuable piece may accidentally come off the item of jewelry and be suctioned into the nozzle. After use, the user may pull on the handle 240 outward (i.e. distally) to remove the handle 240 from the body 210, and collect any valuable residue from the grill 234 and/or wash the grill 234. The grill 234 may then be once more mounted into the body 210 as described heretofore for subsequent use. It must be noted that alternative grill embodiments are contemplated, such as lacking a handle; an example of such an embodiment is shown in FIG. 3 and indicated with reference numeral 234'. As shown in FIG. 3, the shape and arrangement of the openings 238 may vary in different embodiments of the invention; for instance, the grill 234', a front elevation view of which is also shown on a leftmost area of the figure, includes circular openings interspersed with elongated, radially oriented openings or slots.

Figure 6:
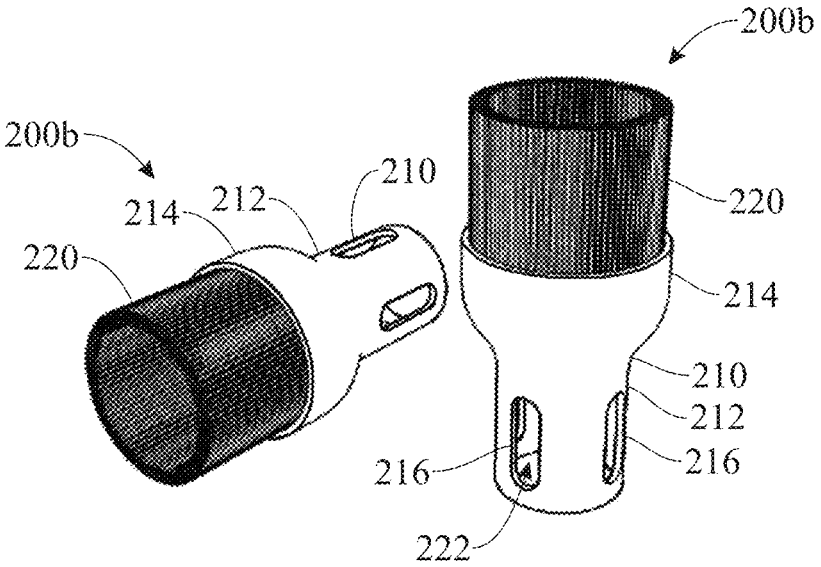
FIG. 6 presents two perspective views of a second suction nozzle of the set of interchangeable suction nozzles of FIG. 2.

The second suction head or nozzle 200*b*, enlarged views of which are shown in FIG. 6, is formed as a small, straight brush generally similar to the first nozzle 200*a*, with only the following differences: the distal section 214 of the body 210 of the second nozzle 200*b* is wider (has a larger diameter) than the distal section 214 of the body 210 of the first nozzle 200*a*; and the brush 220 of the second nozzle 200*b* is longer than that of the first nozzle 200*a*. Similarly to the first nozzle 200*a*, variations of the second nozzle 200*b* are also contemplated, such as having increasingly wider distal sections 214 and increasingly longer brushes 220, and/or having interrupted or uninterrupted brushes. For instance, the illustration of FIG. 10 shows a first variation of the second nozzle 200*b*, indicated with reference numeral 200*b*', which is similar to the second nozzle 200*b* but has an interrupted brush, similarly to nozzle 200*a*' described heretofore. A further variation of the second nozzle 200*b*, indicated with reference numeral 200*b*", is similar to the second nozzle 200*b* but has a yet wider distal section 214, as well as a discontinuous or interrupted brush. A third variation, indicated with reference numeral 200*b*'", is similar to the second variation 200*b*", but instead includes a continuous brush. It should be noted that the width (outer diameter) of the proximal sections 212 of the different nozzles comprised in the system is generally the same (as best shown in the side elevation views provided at the bottom of FIG. 10), with all nozzles being able to be interchangeably attached to a same end connector 144 in accordance with the present disclosure. For instance, in a preferred embodiment, the outer diameter of the proximal section 212 may be 20 mm. The total length of the body 210 may be 40 mm. The openings 216 may each measure 5 mm by 15 mm. The different protruding lengths of the brushes 220 may be 25, 30 and 35 mm, with an additional 10 mm length of the brushes 220 received within the internal annular recesses 230, such that the brushes 200 have a total length of 35, 40 and 45 mm.

Figure 7:
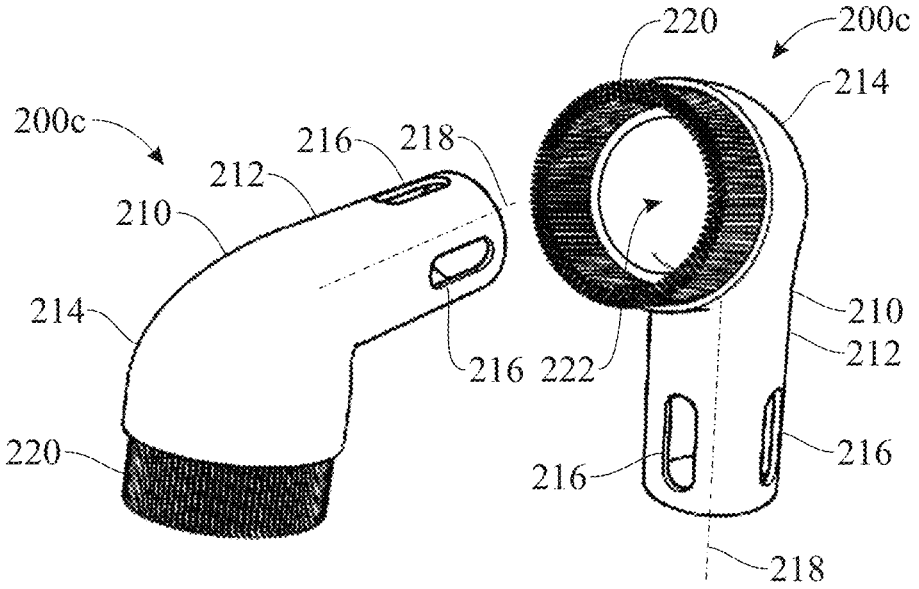
FIG. 7 presents two perspective views of a third suction nozzle of the set of interchangeable suction nozzles of FIG. 2.

Attention is now directed to FIG. 7, which shows enlarged views of the third suction head or nozzle 200*c* of FIG. 2. Similarly to the first and second nozzles 200*a*, 200*b* described heretofore, the third nozzle 200*c* is formed as a brush, and includes a body 210 defining air passageway 222, the body 210 having proximal section 212 configured to attach to the end connector 144 of the head connection terminal 138, the proximal section 212 comprising openings 216 configured to adjustably align with the openings 150 of the end connector 144, and generally wider distal section 214 carrying a brush 220 at a distal end thereof. However, unlike the previous embodiments, the third nozzle 200*c* corresponds to a curved head that allows cleaning in a downward direction. As shown, the distal portion 214 of the body 210 of the third nozzle 200*c*, together with the brush 220 of the third nozzle 200*c*, are arranged along an oblique or transverse direction forming an angle with the central longitudinal axis 218 of the proximal portion 212 of the body 210 of the third nozzle 200*c* such that the brush 220 and the distal portion 214 form a generally curved or curved L-shaped arrangement with the proximal portion 212 of the body 210. This curved or L-shaped arrangement allows the user to orient the brush 220 in a downward direction while holding the brush tube 130 generally forwardly, which is convenient in many situations. For example, this configuration allows reaching over books on a library bookshelf and vacuuming the area behind the books without having to move the books.

Figure 8:
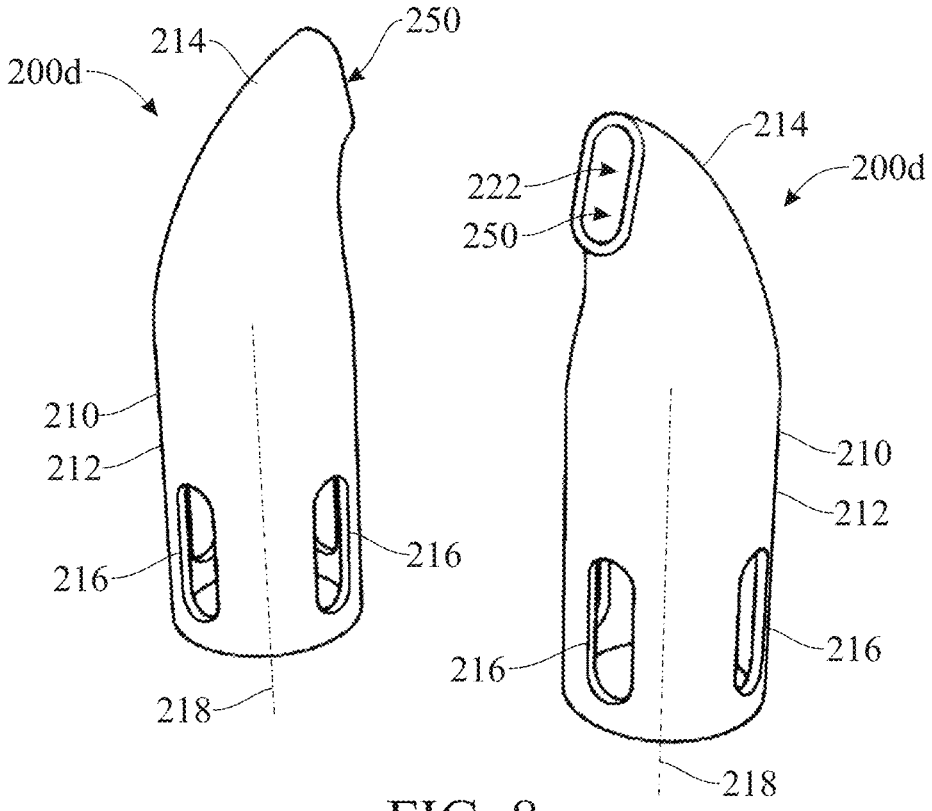
FIG. 8 presents two perspective views of a fourth suction nozzle of the set of interchangeable suction nozzles of FIG. 2.

Referring now to FIG. 8, enlarged perspective views of the fourth suction head or nozzle 200*d* of FIG. 2 are shown. Similarly to previous embodiments, the fourth nozzle 200*d* comprises body 210, the body 210 having a proximal section 212 configured to connect to the end connector 144, the proximal section 212 having openings 26 configured to selectively align with the openings 150 of the end connector 144. The body 210 further includes distal section 214, which extends from proximal section 212 and is laterally curved, similarly to that of the third nozzle 200*c* (FIG. 7). Unlike previous embodiments, however, the distal section 214 of the present embodiment is narrower than the proximal section 212. Also unlike previous embodiments, the nozzle does not include a brush; instead, the distal section 214 of the body 210 ends in a very small opening 250. The opening 250 is elongately formed along generally the longitudinal direction of the nozzle 200*d* (the longitudinal direction being that of the central longitudinal axis 218 of the proximal section 212 of the body 210), with the opening 250 oriented transversely to the longitudinal direction (i.e. facing sideways) and optionally forming a slight forward angle with said longitudinal direction. This small and elongated opening 250 facilitates the aspiration of rails with a limited focus and great power.

Figure 9:
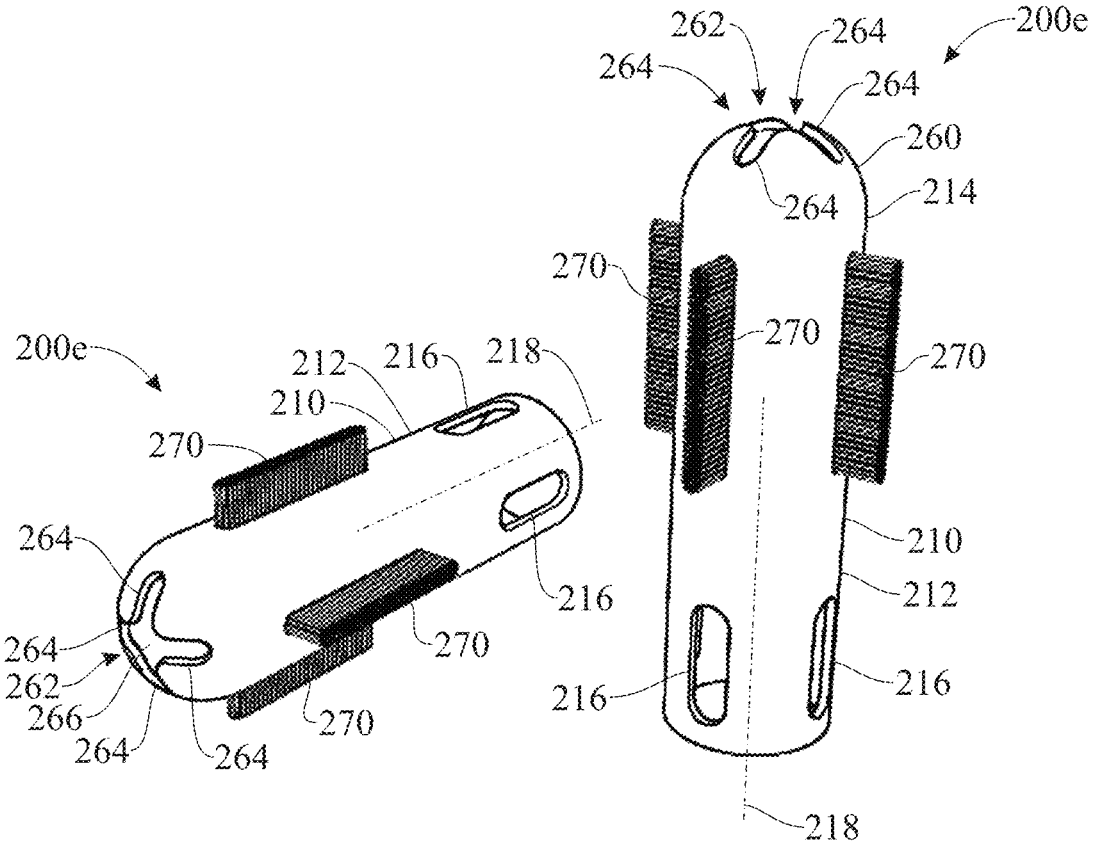
FIG. 9 presents two perspective views of a fifth suction nozzle of the set of interchangeable suction nozzles of FIG. 2.

The illustration of FIG. 9 shows enlarged views of the fifth suction head or nozzle 200*e* of FIG. 2. As can be seen in FIG. 9, the fifth nozzle 200*e* is elongately formed along a longitudinal direction given by the central longitudinal axis 258 of the proximal section 212 of the body 210. The distal section 214 of the body 210 is arranged along said longitudinal direction, coaxially with the proximal section 212 of the body 210. At a distal end thereof, the distal section 214 progressively narrows and terminates in a curved tip or end 260. At the curved end 260, an opening 262 is provided, in fluid communication with the fluid passageway 222 of the body 210. The opening 262 depicted herein is generally cross-shaped or lobed, and includes four segments or lobes 264 extending generally radially from a center 266 of the opening 262, which may be arranged on the central longitudinal axis 258 of the body 210. The nozzle 200*e* further includes a plurality of brushes 270 arranged in the longitudinal direction and angularly spaced apart from one another. For instance, the present embodiment includes four elongate brushes 270 extending in the longitudinal direction and arranged angularly spaced apart with one another. As shown, each brush 270 may be in longitudinal alignment or registration with a respective one of the lobes 264, such that the brushes 270 provide a visual reference to the user as to the position of the lobes 264 during use. The nozzle 200*e* provides a small suction head with lateral brushes, which facilitates suction in 360 degrees, i.e. along the entire periphery of the body 210 about the central longitudinal axis 258. As the nozzle 200*e* is relatively thin and long, it can enter small and difficult-to-access places, with the 360-degree suctioning allowing to then aspirate such small and difficult-to-access locations in their entirety by vacuuming in all directions. The nozzle 200*e* may also be easily and conveniently inserted under pressure in places where it is almost impossible to clean, such as between the folds and spaces in upholstered sofas and armchairs, where lint, food and other debris tend to collect.

The illustration of FIG. 3 shows yet another nozzle 200*f* in accordance with a further embodiment of the invention. The nozzle 200*f* includes a central brush 220*f* and a peripheral opening 228 disposed radially outward of and surrounding the central brush 220*f*. The peripheral opening 228 is in fluid communication with the air passageway 222 of the nozzle 200*f*. This nozzle configuration may allow for a highly precise brushing and wiping off of debris from a small area or spot, and efficient brushing of the debris all around the small and precise area or spot.

The present invention further refers to a method for cleaning using the disclosed suction accessory device. The method includes the following steps:

a) connecting the proximal end of the flexible and lightweight hose 110 of the suction accessory device 100 to a hose of a vacuum cleaner or other suction device (e.g. the hose 602 of the vacuum cleaner 600 of FIG. 1), by connecting the reducing coupling adapter terminal 114 of the hose 110 to a distal end of the hose of the vacuum cleaner or other suction device;

b) connecting the brush tube 130 to the distal end of the hose 110 by threading the hose terminal 134 of the brush tube 130 to the nozzle connection terminal 118 of the hose 110;

c) connecting an interchangeable suction head or nozzle 200 to the distal end of the brush tube 130, by coupling the nozzle 200 to the head connection terminal 138 that, in turn, is carried by the brush tube 130 and the distal end thereof; and d) operating the vacuum cleaner or suction device (e.g., vacuum cleaner 602) to clean hard-to-reach places and delicate objects.

The accessory device of the present disclosure can be connected to a vacuum cleaner to perform cleaning tasks in hard-to-reach places and in objects and places that are delicate to clean. The flexible hose 110 and brush tube 130 allow for efficient cleaning in a small field of action, punctual and spatially limited, through delicate movements and in a manner that is positionally comfortable or ergonomic for the user. The smaller size, light weight, and easy manual maneuverability of the brush tube 130, as well as the ability to customize the components of the suction accessory device 100, allow the suction accessory device 100 to perform a series of new domestic and non-domestic functions that a traditional vacuum cleaner cannot perform. These new functions refer especially to tasks where greater delicacy and accessibility are required, such as cleaning works of art or books, and places that are difficult to access such as under seats, racks, etc.

The invention, when referring to cleaning tasks, refers to cleaning dusty or other debris from a place or object of interest by absorbing it with a vacuum cleaner.

The present invention, when referring to cleaning tasks in hard-to-reach places, we include spaces inside the automobile; spaces under and behind chairs, furniture and appliances; spaces in workshops; spaces in laboratories; spaces in libraries; Hard-to-reach spaces such as shelves, shelves, warehouses, warehouses or any spatially difficult-to-access place.

Also part of the scope of the invention is the cleaning of objects or pieces of archaeology; objects, pieces, paintings for exhibition in museums; antiques; valuables such as jewelry; laboratory material or any other object that requires delicacy to be cleaned. The cleaning of books and exhibits is also within the scope of the invention.

When the connection or union of the components of the device to each other or to the suction apparatus is pointed out, it is referring to the physical coupling of the components. The joining of the components can be temporary, dislodging or uncoupling the components when the user deems it necessary.

In instances where "making the vacuum cleaner or suction device work" is mentioned, such language refers to turning on the device. The device may or may not be connected to the electrical current, in accordance with different models or types of vacuum cleaners/suction devices.

The present invention solves the problems of utility, maneuverability and delicate cleaning that have hitherto existing accessory devices. In addition, it gives the user the possibility of cleaning in a safe, delicate, and comfortable way. This invention provides a device that allows the user to maintain a comfortable posture when performing cleaning activities efficiently, delicately, and safely in a smaller, punctual and limited field of action, in a particular object or place.

PRACTICAL APPLICATION EXAMPLES

Examples of application of the suction accessory device of the present disclosure are provided below to demonstrate the applications and functions of the suction device accessory.

Example 1: Accessory Device for Suction Devices

In one example of the invention, the accessory suction device 100 comprises a flexible hose 110 made of light plastic. The flexible hose 110 has a length of 2 m and a diameter of 2 cm. This flexible hose is connected at one end with the tube 602 of the suction device or vacuum cleaner 600 (FIG. 1). At a first end thereof, the flexible hose 110 incorporates the reducing coupling adapter terminal 114, which allows the user to easily and completely connect the hose 100 to the vacuum cleaner 600. At the other end, the flexible hose 110 is connected to the brush tube 130 by means of the nozzle connection terminal 118. In turn, the brush tube 130 is connected to the interchangeable suction head/nozzle 200 by means of the flexible head connection terminal 138. In this case, the fourth head or nozzle 200*d* was initially attached and then replaced with the fifth head or nozzle 200*e*.

Figure 11:
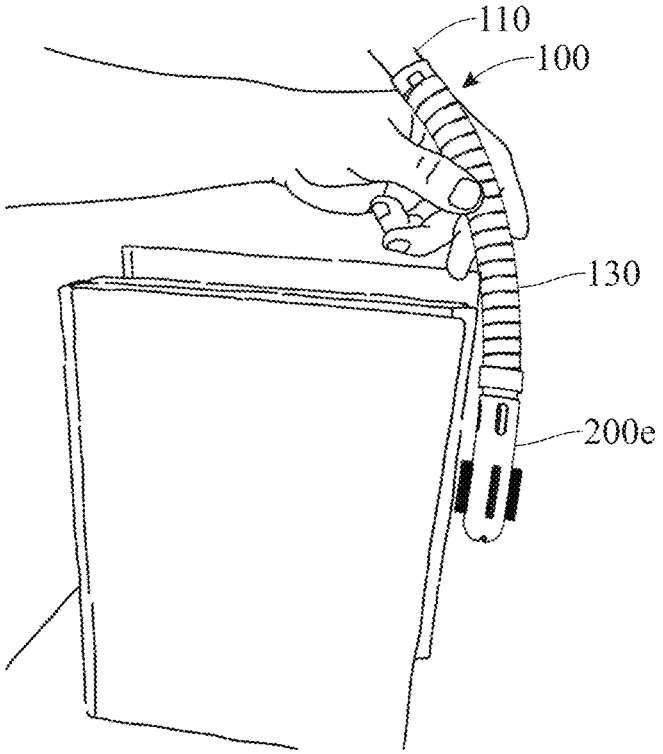
FIG. 11 presents a first example of use of the suction accessory device of the present disclosure, illustrating employability and maneuverability of the device for accessing spaces behind books on bookshelves.
Figure 12:
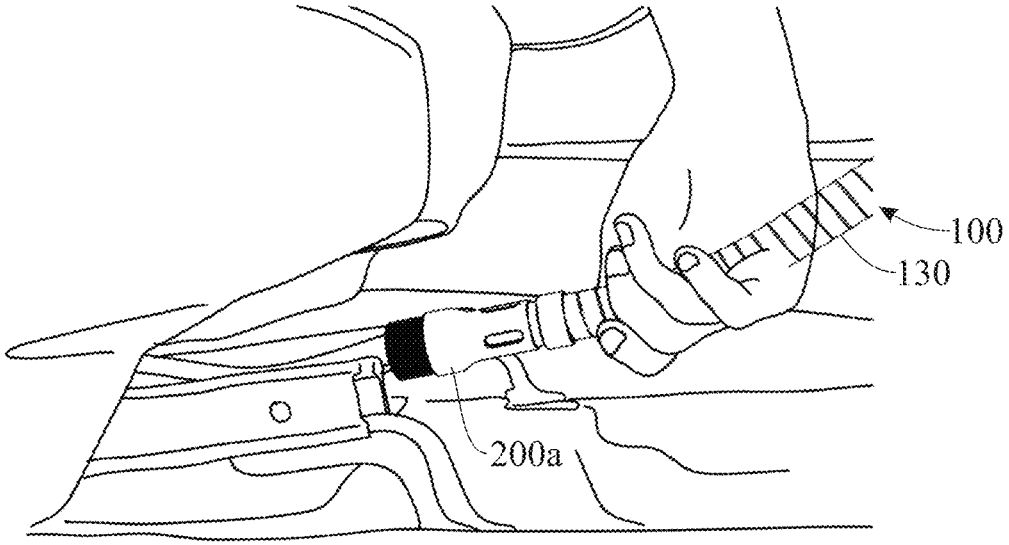
FIG. 12 presents a second example of use of the suction accessory device of the present disclosure, illustrating employability and maneuverability of the device for accessing a space under a car seat.

When the assembly of the entire vacuum operating system that includes the vacuum cleaner 600 and the suction accessory device 100 was completed, the vacuum cleaner 600 was turned on and used in cleaning different places that are difficult to access and on delicate objects such as those shown in FIGS. 11 and 12, i.e. behind books on a bookshelf and underneath a car seat. In this case, a Thomas model V/A/C 1410 vacuum cleaner was used, which was correctly attached to the accessory suction device 100.

The user was able to easily and comfortably handle and maneuver the device, being able to grasp and hold the device with one hand from the brush handle or tube 130.

Example 2. Evaluation of the Use of the Accessory Suction Device in Places of Difficult Access and Delicate Objects When the operation of the suction accessory device 100 connected to a conventional suction vacuum cleaner was evaluated, the suction accessory device allowed the user to remove or subtract dust from difficult-to-access surfaces such as behind a row of books on a shelf, as shown in FIG. 11, from the bottom to underneath said furniture, without having to take out the books. Preferably, the fifth nozzle 200*e*, or suction head that allows 360° cleaning, was used. However, any suction head or nozzle can be used.

In a second application, the suction accessory device 100 was connected to a conventional vacuum cleaner and provided with suction heads or nozzles 200*a*, 200*b* and 200*c*, for cleaning the interior of a car as shown for instance in FIG. 12. The use of these nozzles for this particular cleaning action allows the user not to bend over inside the car and has greater comfort when cleaning.

Figure 13:
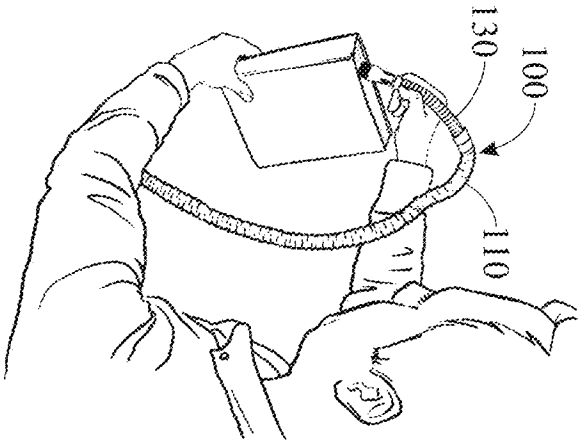
FIG. 13 presents a third example of use of the suction accessory device of the present disclosure, illustrating employability and maneuverability of the device for cleaning delicate objects that are difficult to handle, such as for delicate cleaning of books.
Figure 14:
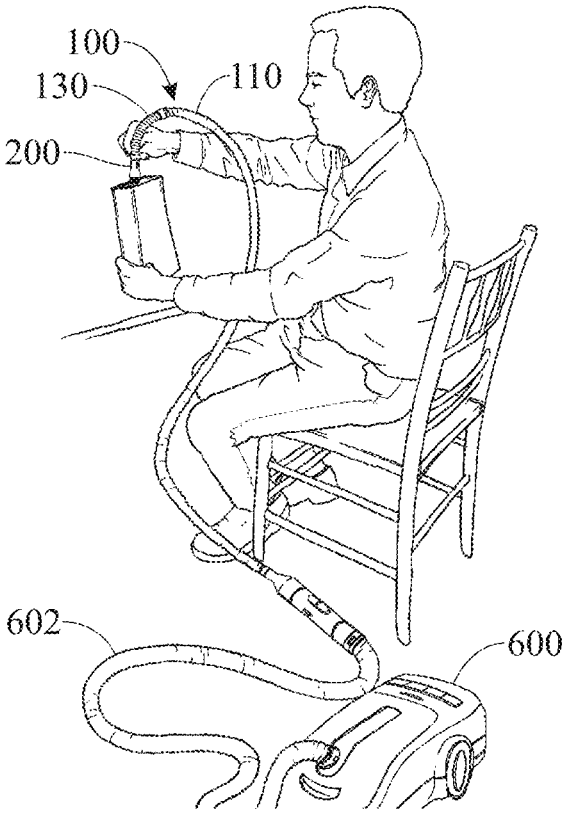
FIG. 14 presents a fourth depiction of use of the suction accessory device of the present disclosure, illustrating employability and maneuverability of the brush tube and the flexible hose of the suction accessory device, contributing to the gentle and delicate cleaning of the object of interest.

In another application, the accessory device was used in the gentle and guided cleaning of delicate objects that must be cleaned with caution. In this case, a user cleaned a book with the device, as shown in FIG. 13, observing the ability of the relatively long, thin and flexible hose 110 of the device to provide maneuverability and smoothness of the dust removal movements on the books without damaging them, as best shown in FIG. 14.

Example 3: Comparison of the Suction Accessory Device with Other Devices of the Prior Art Next, a general comparison of the most important technical characteristics of the device for suction devices with respect to similar devices described in the closest state of the art is presented.

In the following table (Table 1) it is possible to observe that the suction accessory device, unlike similar devices, includes interchangeable heads, a flexible material hose and a brush tube. These components, per their spatial and functional structure, allow the suction accessory device to be used in a versatile way with any suction device or vacuum cleaner.

TABLE 1

Comparison of Technical Parameters of the Suction Accessory Device with Other Devices of the Prior Art.

| | Inter-changeable heads | Flexible material hose | Brush tube | Versatility of use with suction devices | Gentle and guided cleaning for delicate objects and hard-to-reach places |
|---|---|---|---|---|---|
| U.S. Pat. No. 8,627,544 | x | ✓ | x | x | x |
| CN101273862A | x | x | ✓ | x | x |
| U.S. Pat. No. 9,596,967 | x | ✓ | ✓ | x | x |
| CN204445690U | x | x | x | x | x |
| Device of present invention | ✓ | ✓ | ✓ | ✓ | ✓ |

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A suction accessory device, comprising:

a flexible, first tubular member, comprising a proximal end and a distal end, the first tubular member having a length of 2 m and a diameter of between 1 to 4 cm;

a second tubular member, comprising a proximal end and a distal end, the second tubular member having a length of 20 to 30 cm and a diameter of 1 to 4 cm, the proximal end of the second tubular member being connected to the distal end of the first tubular member;

an interchangeable suction nozzle detachably connectable to the distal end of the second tubular member, the suction nozzle having a downwardly curved nozzle head that have one or more nozzle openings, one or more brushes attached to the one or more nozzle openings for cleaning in a downward direction, and a head connection terminal slidably and rotatably inserted onto an inner diameter of the nozzle head, the nozzle head having one or more first side openings, the head connection terminal having one or more second side openings, wherein one of the nozzle head and the head connection terminal is rotated relative to the other one of the nozzle head and the head connection terminal such that the one or more first side openings of the nozzle head and the one or more second side openings of the head connection terminals align with each other, and a degree of the alignment of the one or more first side openings with the one or more second side openings selectively adjusts an amount of air to be expelled through said one or more first side openings and said one or more second side openings and prevent said amount of air from reaching a vacuum cleaner hose; and a reducing coupling adapter terminal affixed to the proximal end of the first tubular member and configured to adapt the diameters of the first tubular member and the vacuum cleaner hose, wherein a proximal end of the reducing coupling adapter is configured to detachably connect to the vacuum cleaner hose, and the first tubular member has a smaller diameter and is more flexible than the vacuum cleaner hose, and wherein the second tubular member is made of metal or plastic that is less flexible than the first tubular member.

2. The suction accessory device of claim 1, further comprising a grid within the second tubular member, the grid configured to filter air passing through the second tubular member.

3. The suction accessory device of claim 1, wherein the brushes are made of natural hair.

4. The suction accessory device of claim 1, further comprising a nozzle connection terminal at the distal end of the second tubular member, wherein the suction nozzle is configured to detachably connect to the nozzle connection terminal.

5. The suction accessory device of claim 1, wherein the suction nozzle comprises a hollow body defining a fluid passageway therethrough, the body comprising a proximal section and a distal section, wherein the proximal section is formed along a first axial direction and the distal section is formed along a second axial direction that intersects with the first axial direction.

6. The suction accessory device of claim 5, wherein the one or more brushes comprise a circular brush extending outward in the second axial direction from a periphery of the one or more nozzle openings and continuously surrounding the one or more nozzle openings.

7. The suction accessory device of claim 5, wherein the one or more brushes comprise a plurality of brushes extending outward in the second axial direction from a periphery of the one or more nozzle openings, the plurality of brushes arranged in spaced-apart relationship and interruptedly surrounding the one or more nozzle openings.

8. The suction accessory device of claim 5, wherein the one or more brushes comprise a central brush extending outward in the second axial direction, and further wherein the one or more nozzle openings are arranged radially outward of the central brush.

9. The suction accessory device of claim 5, wherein the one or more brushes comprise a plurality of brushes extending radially outward of the distal section at angularly-spaced apart positions along the distal section.

* * * * *